US006581247B1

(12) United States Patent
Yu Chen

(10) Patent No.: US 6,581,247 B1
(45) Date of Patent: Jun. 24, 2003

(54) HANDLE OF AN ADHESIVE-TAPE CUTTER

(76) Inventor: Hsiu-Man Yu Chen, No. 27, Sec. 1, Dafu Rd., Tantz Shiang, Taichung (TW), 427

( * ) Notice: Subject to any disclaimer, the term of this patent is extended or adjusted under 35 U.S.C. 154(b) by 22 days.

(21) Appl. No.: 10/004,451

(22) Filed: Dec. 5, 2001

(51) Int. Cl.[7] ..... B25G 3/00; B25G 1/01

(52) U.S. Cl. ..... 16/430; 16/436; 16/DIG. 12; 16/DIG. 19

(58) Field of Search ..... 16/430, 431, 436, 16/DIG. 12, DIG. 19; 81/117.1, 427.5, 489; 30/340; 264/250, 254, 255, 259, 277.1, 273, 274; 294/16, 17; 156/579; 173/169, 162.2

(56) References Cited

U.S. PATENT DOCUMENTS 4,645,235 A * 2/1987 Joseph ..... 16/DIG. 12
4,837,892 A * 6/1989 Lo ..... 16/431
5,290,063 A * 3/1994 Lenhart ..... 280/821
5,640,741 A * 6/1997 Yano ..... 16/421
5,964,009 A * 10/1999 Hoepfl et al. ..... 16/430
6,094,781 A * 8/2000 Jansson et al. ..... 16/431
6,108,870 A * 8/2000 Lo ..... 16/431
6,122,802 A * 9/2000 Lo ..... 16/431
6,138,734 A * 10/2000 Hamisch, Jr. ..... 156/384
6,161,256 A * 12/2000 Quiring et al. ..... 16/431
6,230,366 B1 * 5/2001 Lin ..... 16/431
6,473,939 B1 * 11/2002 Stegmaier ..... 16/436

* cited by examiner

*Primary Examiner*—Chuck Y. Mah
(74) *Attorney, Agent, or Firm*—Troxell Law Office PLLC

(57) ABSTRACT

A handle of an adhesive-tape cutter includes a recessed groove formed at a preset position of the handle, having insert holes preset in number formed around its circumference. A cover member is provided at a bottom side with a plurality of insert studs for correspondingly inserting in the insert holes of the handle. The cover member has a cover plate provided with at least one engraved groove on its faceplate for words, designs or a trademark to be embedded therein. A resilient covering covers up a preset portion of the handle and filled up the engraved groove. Words, designs or a trademark is embedded and protected in the engraved groove so they will not be worn out, fade in color or fall off.

3 Claims, 5 Drawing Sheets

HANDLE OF AN ADHESIVE-TAPE CUTTER

BACKGROUND OF THE INVENTION

This invention relates to an adhesive-tape cutter, particularly to one with its handle having a comfortable feeling in grasping and capable to let the handle and a trademark, words or designs formed in shape together.

A conventional adhesive-tape cutter, as shown in FIG. 1 includes a frame 10, a tape roll base 11 provided on a rear side of the frame 10 for placing an adhesive-tape roll. The adhesive tape of the tape roll winds through under a roller 12 in its front, stretches upwards and then passes through a blade base 13 and a press plate 14. In using, the adhesive tape is pressed and held by the blade of the press plate 14 to slide and glue on a cardboard box and then cut off by the blade base 13 after finishing gluing work.

The conventional adhesive-tape cutter has a handle 15 secured under the frame 10, made of plastic and formed with injection molding. Besides, the handle 15 has a plastic-foamed sleeve 16 fitted around its outer circumference in order to increase comfort in grasping. However, the sleeve 16 is made by foaming plastic of low density, so such plastic-foamed sleeve 16 will absorb water, sweat and oil and also accumulate ashes in its inner hollow space, thus, easily soiled and greatly affecting a user's health. Besides, the plastic-foamed sleeve 16 is liable to deform and even peel off after a long-term of grasping and compressing, seriously spoiling the esthetic appearance of products.

In addition, words designs or stamps of a trademark printed on the faceplate of the frame 10 of a conventional adhesive-tape cutter are easy to be worn out and become hard to recognize due to constant use.

SUMMARY OF THE INVENTION

The main objective of the invention is to offer a handle of an adhesive-tape cutter, covered with a resilient covering so as to have a comfortable feeling of grasping. Besides, words, designs or stamps of the trademark filled with artificial rubber are embedded and protected in the engraved groove of the cover member so as to prevent them from wearing off, from fading in color and from peeling off.

Another objective of the invention is to offer a handle of an adhesive-tape cutter, having a cover member provided with combination strips preset in number formed on the bottom surface of the engraved groove. Thus, after the resilient covering injected in extends onto the combination strips and is solidified, it will press and keep them steady so as to increase stability of the cover member.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
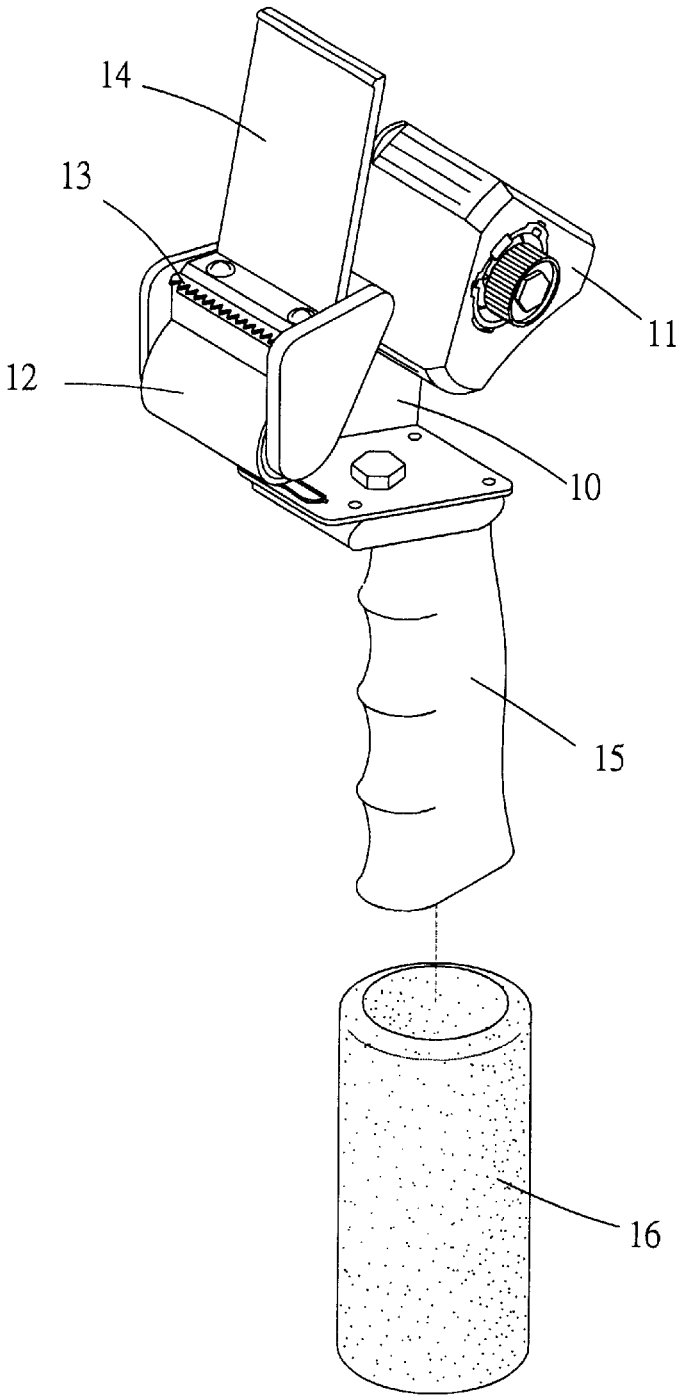
FIG. 1 ( Prior Art )
FIG. 1 is a perspective view of a conventional adhesive-tape cutter.
Figure 2:
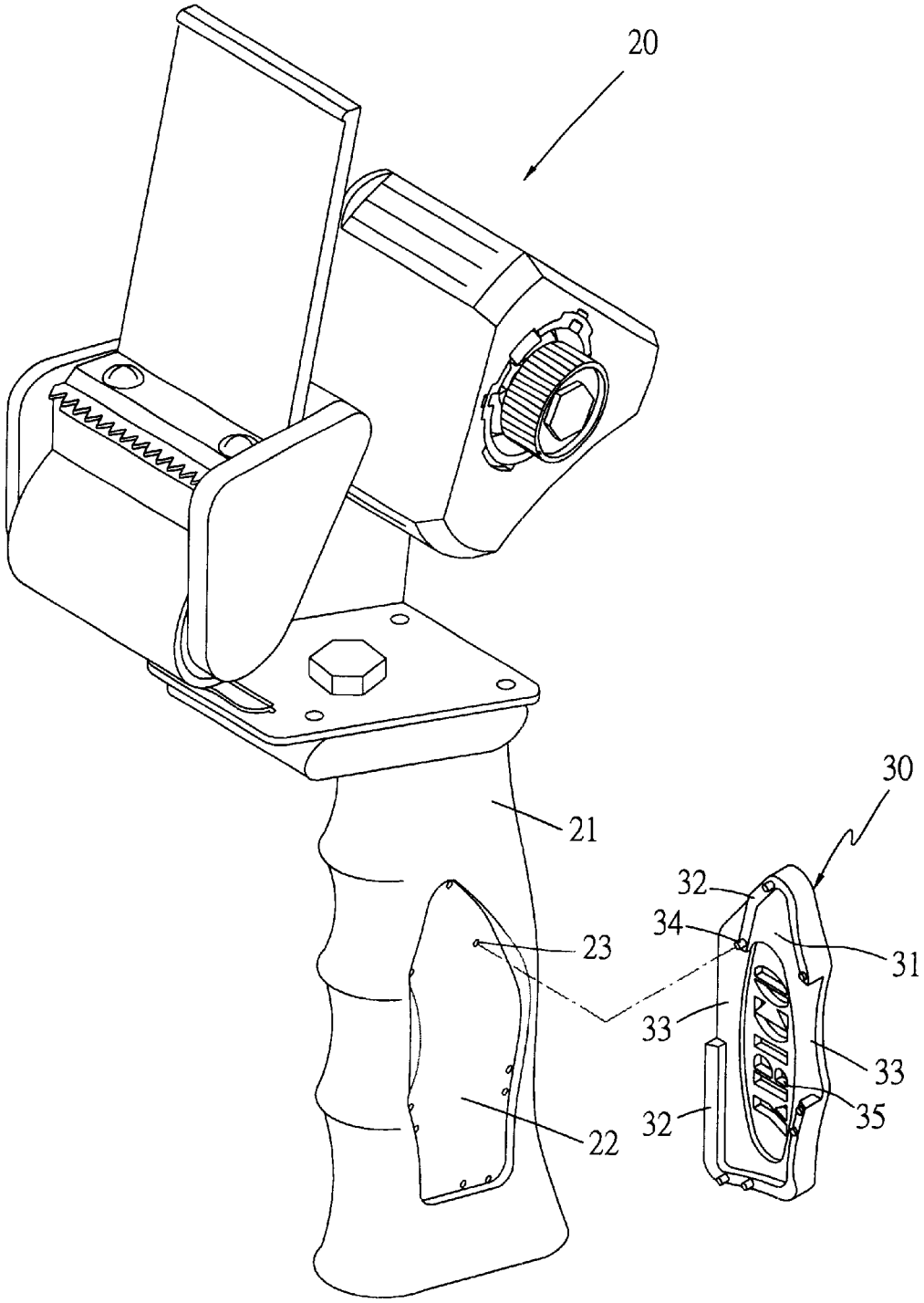
FIG. 2 is an exploded perspective view of an adhesive-tape cutter with a cover member in the present invention.
Figure 3:
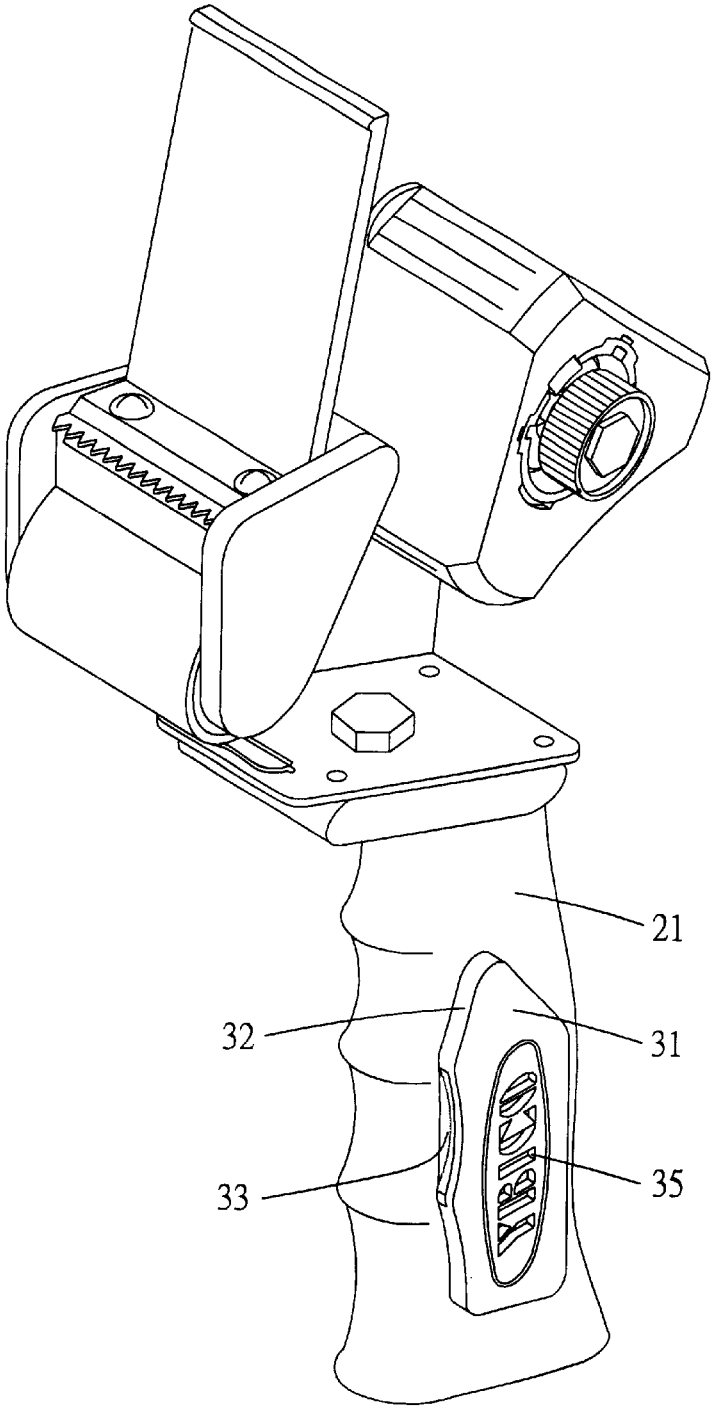
FIG. 3 is perspective view of the adhesive-tape cutter, with the cover member closely fitted with the handle in the present invention.
Figure 4:
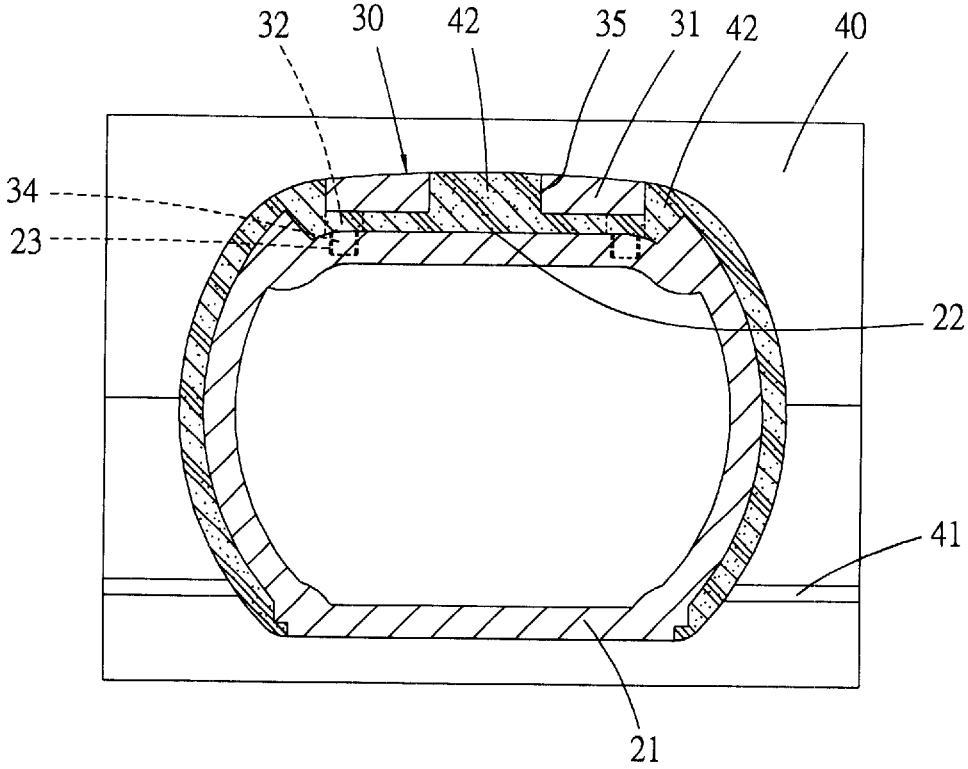
FIG. 4 is a perspective view of a mold in the present invention.

A preferred embodiment of the handle of an adhesive-tape cutter in the present invention, as shown in FIGS. 2, 3 and 4, includes a handle 21 and a cover member 30 and a resilient covering as main components.

The handle 21 provided under the adhesive-tape cutter is an interior hollow casing made of plastic, having a recessed groove 22 formed in an intermediate portion of one side. The recessed groove 22 has a plurality of insert holes 23 preset in number provided around its circumference, with the insert holes not passing through the casing of the handle 21, as shown in FIG. 4.

The cover member 30 is made of plastic to be firmly fitted in the recessed groove 22 of the handle 21. The cover member 30 is provided with a cover plate 31 having semi-annular protruding edge frames 32 respectively formed on an upper and a lower portion. Then, two dented openings 33 are respectively formed in the centers of the opposite sides of the cover plate 31 and a plurality of insert studs 34 are respectively provided on a bottom side of the protruding edge frames 32 of the cover plate 31 to be correspondingly received in the insert holes 23 of the recessed groove 22 of the handle 21. Further, the cover plate 31 has an engraved groove 35 on the faceplate for words, designs or a trademark to be embedded therein.

In assembling, as shown in FIGS. 3 and 4, firstly insert the insert studs 34 of the protruding edge frames 32 into the insert holes 23 of the recessed groove 22 to combine the cover member 30 with the handle 21 together, with the bottom side of the protruding edge frames 32 of the cover member 30 closely contacting with the surface of the recessed groove 22 of the handle 21. The dented opening 33 is formed respectively in a center portion of opposite sides of the cover plate 31, because the upper and the lower protruding edge frames 32 of the cover member 30 are of a preset height.

Next, the handle combined with the cover member 30 is placed in a mold 40 and then inject in a resilient covering 42 of rubber or artificial rubber (PPR) through an inject hole 41, letting the rubber cover around the handle 21 and some extend into the recessed groove 22 through the dented opening 33 and then fill up the engraved groove 35 of the cover member 30, letting the words, the designs or the trademark in the engraved groove 35 filled with artificial rubber.

Figure 5:
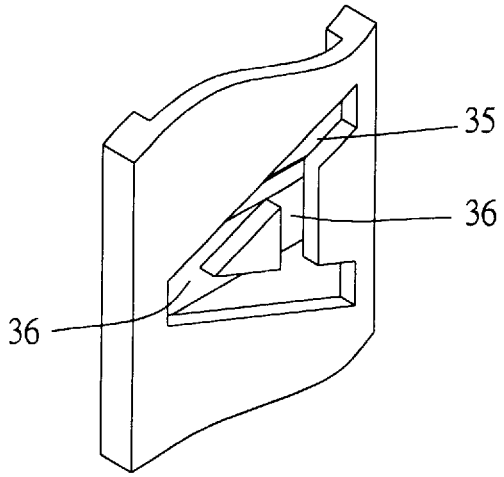
FIG. 5 is a partially perspective view of the engraved groove of the cover member in the present invention.
Figure 6:
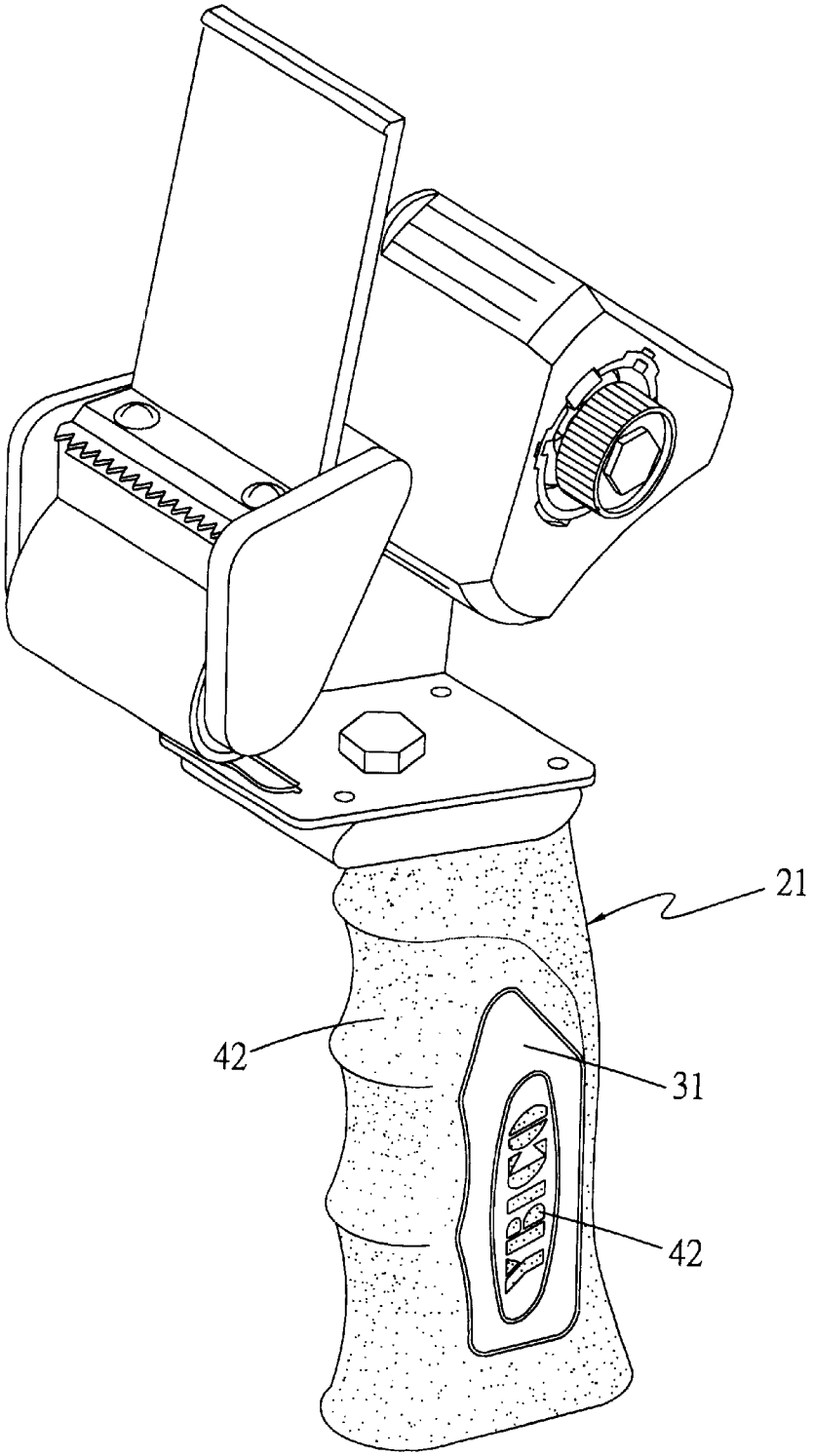
FIG. 6 is a perspective view of the adhesive-tape cutter assembled in the present invention.

Furthermore, as shown in FIG. 5, one or more combination strip 36 can be provided on the bottom portion of the engraved groove 35 of the cover member 31. Thus, after the resilient covering 42 injected in extends to the combination strip 36 and is solidified in shape, the resilient covering 42 will permanently compress the combination strip 36 so as to increase its stability, preventing the cover member from falling off.

As can be noted from the above description, this invention has some advantages described below.

1. The handle 21 is covered up with a resilient covering 42 of artificial rubber, having a comfortable feeling of grasping, and its profile is formed according to ergonomic engineering, increasing suitability of grasping.

2. Words, designs or a trademark are filled with artificial rubber, so it is possible to make their color different from that of the cover member 30, thus beautifying the handle 21, and besides, the words, the designs or the trademark are embedded and protected in the engraved groove 35 of the cover member 30, preventing them from worn out, fading in color and peeling off.

While the preferred embodiment of the invention has been described above, it will be recognized and understood that various modifications may be made therein and the appended claims are intended to cover all such modifications that may fall within the spirit and scope of the invention.

I claim:

1. A handle of an adhesive-tape cutter comprising a handle, a cover member and a resilient layer;

Said handle having a recessed groove formed in a predetermined position, said recessed groove provided with insert holes preset in number around its circumference;

Said cover member provided at a bottom side with a plurality of insert studs correspondingly received in said insert holes of said handle, said cover member further having a cover plate provided with at least one engraved groove on its faceplate for words, designs or a trademark to be embedded and protected therein, said cover plate having a dented opening respectively in a center portion of two opposite sides;

Said resilient layer covering up a preset portion of said handle and extending into said recessed groove of said handle through said dented opening and then filling up said engraved groove.

2. The handle of an adhesive-tape cutter as claimed in claim 1, wherein said cover plate is provided with a protruding edge frame on an upper portion and a lower portion.

3. The handle of an adhesive-tape cutter as claimed in claim 1, wherein said engraved groove is provided with at least one combination strip to be fixedly compressed by said resilient covering when said resilient covering extends to it and is solidified, preventing said cover member from falling off.

* * * * *